US006459329B1

(12) United States Patent
Kobayashi et al.

(10) Patent No.: US 6,459,329 B1
(45) **Date of Patent: *Oct. 1, 2002**

(54) POWER SUPPLY AUXILIARY CIRCUIT

(75) Inventors: Isamu Kobayashi; Syuichi Saito; Hajime Sato, all of Kasugai (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/037,917

(22) Filed: Mar. 10, 1998

(30) Foreign Application Priority Data

Oct. 17, 1997 (JP) ..... 9-285552

(51) Int. Cl.[7] ..... G05F 1/10; G05F 3/02
(52) U.S. Cl. ..... 327/538; 327/112; 327/427
(58) Field of Search ..... 327/362, 378, 327/427, 434, 437, 530, 538, 540, 541, 543, 112

(56) References Cited

U.S. PATENT DOCUMENTS 5,066,873 A * 11/1991 Chan et al. ..... 307/443
5,440,258 A * 8/1995 Galbi et al. ..... 327/541
5,880,624 A * 3/1999 Koyanagi et al. ..... 327/541

FOREIGN PATENT DOCUMENTS

| | | |
|---|---|---|
| JP | 04032088 A | 2/1992 |
| JP | 05-217370 | 8/1993 |
| JP | 9-285552 | 1/2002 |

* cited by examiner

*Primary Examiner*—Terry D. Cunningham
*Assistant Examiner*—Quan Tra
(74) *Attorney, Agent, or Firm*—Arent Fox Kintner Plotkin & Kahn

(57) ABSTRACT

An internal power supply auxiliary circuit supplies a current to a power generator circuit. A pulse signal generator receives an input signal and outputs a first control signal. A driver circuit connected to the pulse signal generator receives the first control signal, an external supply voltage and a source voltage, and generates a drive pulse signal. A current supply driver circuit receives the drive pulse signal and the external supply voltage and outputs the supply current to the power generator circuit. A gate voltage regulator circuit connected to the driver circuit receives a reference voltage and produces the source voltage. The gate voltage regulator causes the source voltage to substantially match the reference voltage so that the current supplied to the power generator circuit does not exceed a predetermined value.

21 Claims, 7 Drawing Sheets

10
19
Internal power generator
Is
23
TP2
Vcc
22
TP1
Pgate
TN1
Vcc
Ps
25f
24c
25e
25d
24b
25c
24a
25b
25a
21
in
11
N1
R1
Vcc
TN2
GND
20
TP3
TN3
12
GND
TP5
Vcc
TP4
TN4
N2
TN5
en
Vref
13
Reference voltage generator

POWER SUPPLY AUXILIARY CIRCUIT

BACKGROUND OF THE INVENTION

The present invention relates generally to an internal power supply auxiliary circuit which supplies a current to an internal power generator in a semiconductor integrated circuit device, and, more particularly, to prevention of an increase in current consumption of an internal power supply auxiliary circuit.

High integration of semiconductor integrated circuit devices and the miniaturization of internal elements have reduced the withstand voltage of transistors. In this respect, semiconductor integrated circuit devices have an internal power generator which receives an external supply voltage and produces an internal supply voltage. When a sense amplifier in a semiconductor integrated-circuit device which includes a DRAM, for example, starts operating, the current capacity of the internal power supply decreases. Therefore, semiconductor integrated circuit devices are equipped with an internal power supply auxiliary circuit which receives power from an external power supply and supplies a current to the internal power generator.

FIG. 1 is a circuit diagram of a conventional internal power supply auxiliary circuit 20. The internal power supply auxiliary circuit 20, which is a pulse-switched type regulator, comprises a pulse signal generator 21, a driver-driving circuit 22 and a current supply driver 23.

The pulse signal generator 21 includes NAND gates 24*a* to 24*c* and inverters 25*a* to 25*f*. The pulse signal generator 21 receives an input signal in having a low level and outputs a control signal Ps having a low level, and receives a high-level input signal in and outputs a high-level control signal Ps during the operation delay time of the NAND gates 24*a*–24*c* and the inverters 25*a*–25*f*.

The driver-driving circuit 22 includes a CMOS inverter which is comprised of PMOS and NMOS transistors TP1 and TN1. The CMOS inverter receives the control signal Ps and sends a drive pulse signal Pgate to the current supply driver 23.

The current supply driver 23 has a PMOS transistor TP2, which has a source for receiving an external supply voltage $V_{cc}$, a gate for receiving the drive pulse signal Pgate and a drain connected to the current supply terminal of an internal power generator 19.

When a sense amplifier circuit of, for example, a DRAM initiates its operation, an excessive current is supplied to a load from the internal power generator 19. At this time, the high-level input signal in is supplied to the internal power supply auxiliary circuit 20, and the pulse signal generator 21 outputs the high-level control signal Ps for a predetermined period of time. In response to the high-level control signal Ps, the driver-driving circuit 22 outputs the drive pulse signal Pgate of a low (ground GND) level. In response to the low-level drive pulse signal Pgate, the PMOS transistor TP2 of the current supply driver 23 is turned on to supply a supply current Is to the internal power generator 19.

The PMOS transistor TP2 has a size large enough to supply the sufficient supply current Is to the internal power generator 19 even when the external supply voltage $V_{cc}$ is low. When a high external supply voltage $V_{cc}$ is supplied to the PMOS transistor TP2, the excessive supply current Is is output from the PMOS transistor TP2 as shown in FIG. 2, increasing current consumption.

Accordingly, it is an object of the present invention to provide a semiconductor integrated circuit device equipped with an internal power supply auxiliary circuit which prevents current consumption from increasing.

SUMMARY OF THE INVENTION

Briefly stated, the present invention provides a semiconductor integrated circuit device including: an output transistor; a driving circuit for outputting a drive signal which drives the output transistor in response to a control signal, the output transistor outputting a current based on a first supply voltage in response to the drive signal; and a level regulator, connected to the driving circuit, for regulating a voltage of the drive signal in accordance with a change in the first supply voltage.

The present invention provides a reference voltage generator for receiving a supply voltage and outputting a reference voltage from a reference voltage output terminal. The reference voltage generator includes: a first differential amplifier for receiving a substantially constant voltage and outputting from a first output terminal an output voltage substantially equal to the constant voltage; a first voltage-dividing circuit for dividing the supply voltage to produce a first divided voltage; a second voltage-dividing circuit, connected between the reference voltage output terminal and the first output terminal, for dividing a potential difference between the reference voltage and the output voltage to produce a second divided voltage; and a second differential amplifier for receiving the first and second divided voltages from the first and second voltage-dividing circuits and supplying the reference voltage to the reference voltage output terminal by operating so that the second divided voltage becomes substantially equal to the first divided voltage.

The present invention provides a power supply auxiliary circuit for supplying a current to a power generator circuit. The auxiliary circuit includes: a pulse signal generator which receives an input signal and generates a first control signal therefrom; a driver-driving circuit connected to the pulse signal generator for receiving the first control signal therefrom, an external supply voltage, and a source voltage and generates a drive pulse signal therefrom; a current supply driver circuit connected to the driver-driving circuit which receives the drive pulse signal and the external supply voltage and outputs a supply current to the power generator circuit; a reference voltage generator for producing a reference voltage; and a gate voltage regulator circuit connected to the driver driving circuit and the reference voltage generator, the gate voltage regulator circuit receiving the reference voltage and producing the source voltage, wherein the gate voltage regulator causes the source voltage to substantially match the reference voltage.

The present invention provides a semiconductor memory device including: a transistor, disposed between an external power supply line and an internal power supply line, having a gate electrode; a driving circuit, operatively connected to the gate electrode and disposed between a first node and a second node, for controlling the transistor in response to a pulse signal; and a level controlling circuit receiving an external power supply voltage and operatively connected to one of the first and second nodes, for controlling a potential at one of the first and second nodes in response to a potential of the external power supply voltage.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 3:
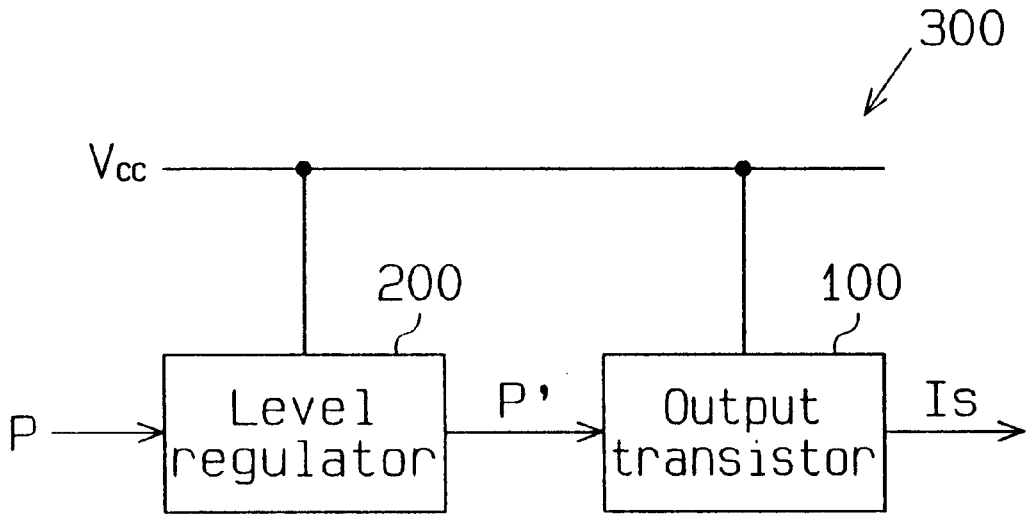
FIG. 3 is a schematic diagram of an internal power supply auxiliary circuit embodying the present invention.

In the drawings, like numerals indicate like elements throughout. FIG. 3 is a block diagram of an internal power supply auxiliary circuit 300 according to the present invention. The internal power supply auxiliary circuit 300 has a level regulator 200 and an output transistor 100. The level regulator 200 adjusts the voltage of a control signal P in accordance with the value of an external supply voltage $V_{cc}$ and outputs a regulation control signal P'. The output transistor 100 receives the regulation control signal P' and outputs a supplement current Is.

Figure 4:
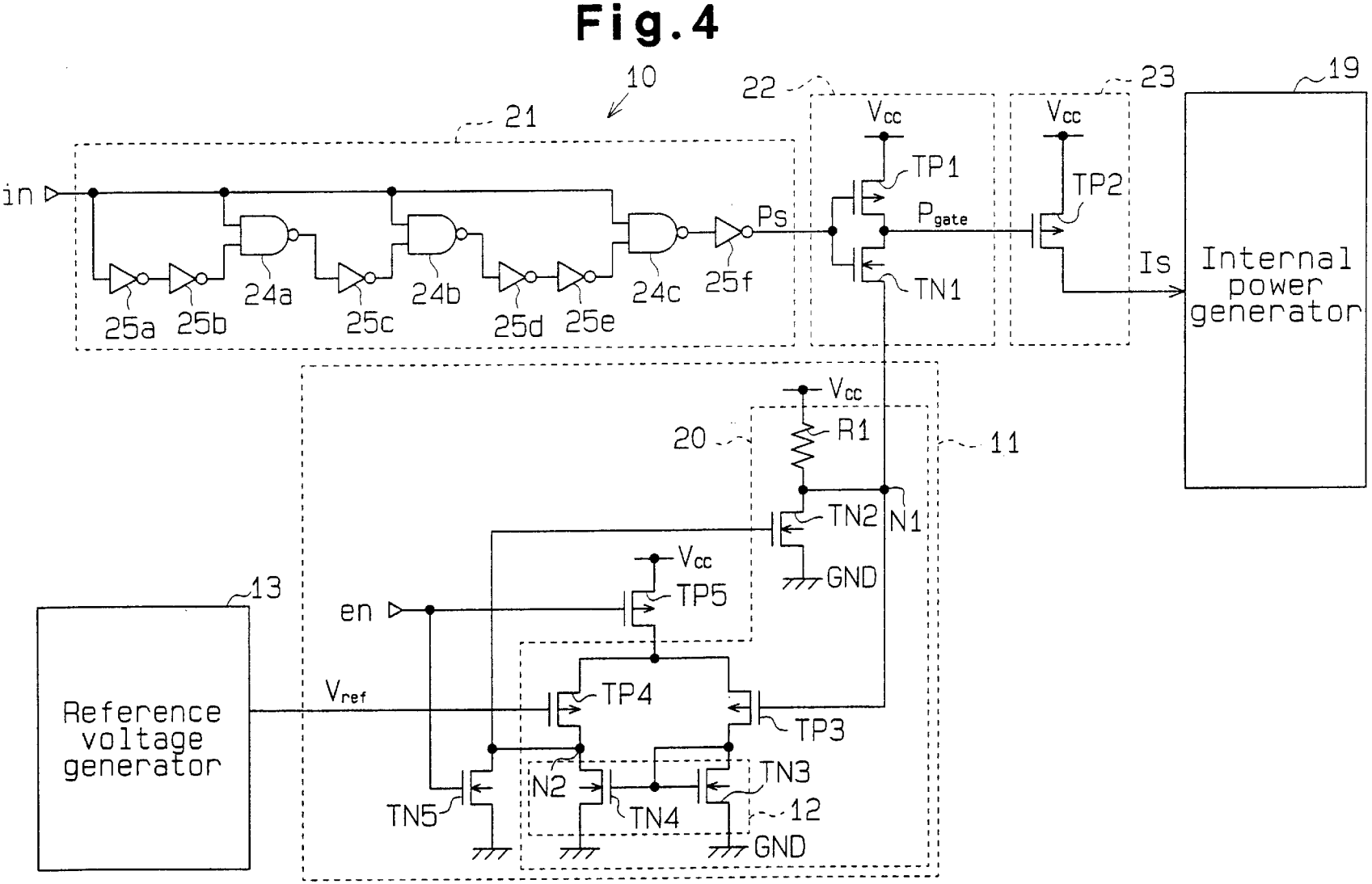
FIG. 4 is a circuit diagram of an internal power supply auxiliary circuit according to a first embodiment of the present invention.

FIG. 4 is a circuit diagram of an internal power supply auxiliary circuit 10 according to a first embodiment of the present invention. The internal power supply auxiliary circuit 10 comprises a pulse signal generator 21, a driver-driving circuit 22, a current supply driver 23, a gate voltage regulator 11 and a reference voltage generator 13. The gate voltage regulator 11 operates such that the source voltage of an NMOS transistor TN1 of the driver-driving circuit 22 substantially matches with a reference voltage Vref. The gate voltage regulator 11 comprises four NMOS transistors TN2 to TN5, three PMOS transistors TP3, TP4 and TP5, and a resistor R1. The reference voltage generator 13 generates the reference voltage Vref (see FIG. 6) which varies by a predetermined ratio as the external supply voltage $V_{cc}$ rises, and supplies the reference voltage Vref to the gate voltage regulator 11.

The NMOS transistor TN2 and the resistor R1 are connected in series between the external supply voltage $V_{cc}$ and ground GND, with a node N1 between the NMOS transistor TN2 and the resistor R1 being connected to the source of the NMOS transistor TN1. The resistor R1 preferably has a resistance substantially higher than the ON resistance of the transistor TN2. The NMOS transistor TN2 has a gate connected via the NMOS transistor TN5 to the ground GND.

The PMOS transistor TP3 has a gate connected to the node N1, a drain connected via the NMOS transistor TN3 to the ground GND, and a source for receiving the external supply voltage $V_{cc}$ via the PMOS transistor TP5.

The PMOS transistor TP4 has a gate for receiving the reference voltage Vref produced by the reference voltage generator 13, a drain connected via the NMOS transistor TN4 to the ground GND and a source which receives the external supply voltage $V_{cc}$ via the PMOS transistor TP5. The PMOS transistor TP5 has a gate which receives an enable signal en from an external control unit (not shown) and functions a switch circuit.

The gates of the NMOS transistors TN3 and TN4 are connected together and to the drain of the NMOS transistor TN3. The NMOS transistors TN3 and TN4 form a current mirror circuit 12. A node N2 between the PMOS transistor TP4 and the NMOS transistor TN4 is connected via the NMOS transistor TN5 to the ground GND. The NMOS transistor TN5 has a gate which receives the enable signal en.

The PMOS transistors TP3 and TP4 and the current mirror circuit 12 form a current-mirror type differential amplifier 20. The non-inverting input terminal of the differential amplifier 20 is the gate of the PMOS transistor TP3, the inverting input terminal is the gate of the PMOS transistor TP4 and the output terminal is the node N2. The node N2 is connected to the gate of the NMOS transistor TN2. The NMOS transistor TN2 and the resistor R1 form the output stage of the differential amplifier 20.

As the PMOS transistor TP5 is turned on, and the NMOS transistor TN5 is turned off, in response to the low-level enable signal en, the gate voltage regulator 11 is enabled.

When the voltage at the node N1 is lower than the reference voltage Vref, the drain current of the PMOS transistor TP3 increases and the drain current of the PMOS transistor TP4 decreases. Accordingly, the drain currents of the NMOS transistors TN3 and TN4 increase. As a result, the voltage at the node N2 drops, reducing the drain current of the NMOS transistor TN2. This raises the voltage at the node N1.

When the voltage at the node N1 is higher than the reference voltage Vref, the drain current of the PMOS transistor TP3 decreases and the drain current of the PMOS transistor TP4 increases. This causes the drain currents of the NMOS transistors TN3 and TN4 to decrease. As a result, the voltage at the node N2 rises, increasing the-drain current of the NMOS transistor TN2. This reduces the voltage at the node N1.

In the internal power supply auxiliary circuit 10 according to the embodiment, the driver-driving circuit 22 outputs a drive pulse signal Pgate, which has the level of the source voltage of the NMOS transistor TN1 (i.e., the voltage at the node N1), in response to a high-level control signal Ps output from the pulse signal generator 21.

Figure 1:
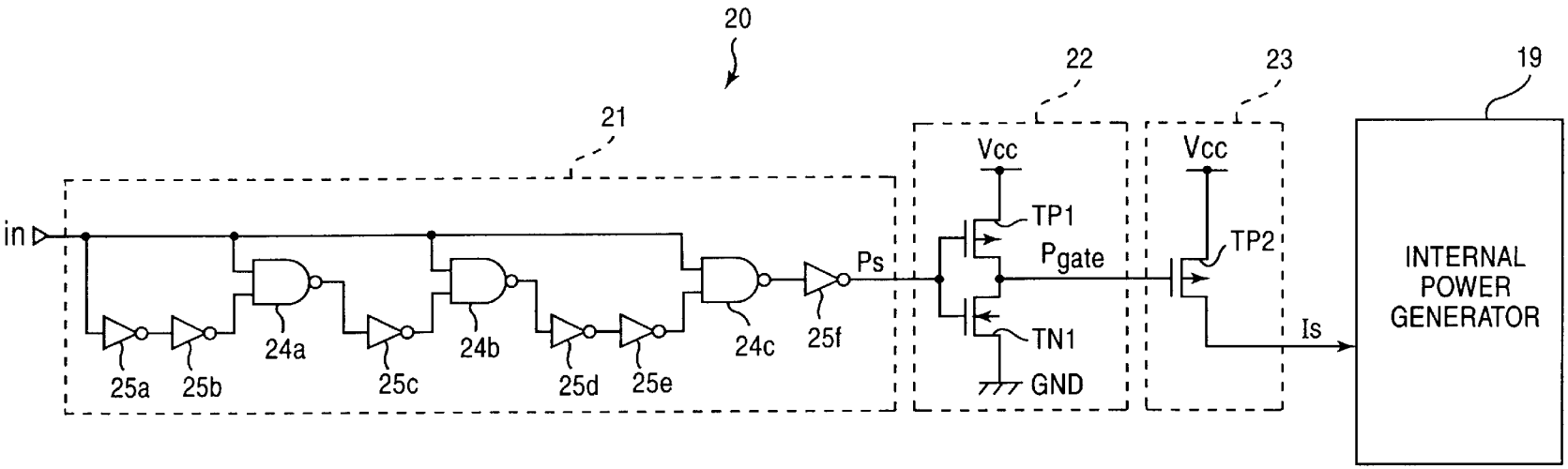
Fig.1 PRIOR ART
FIG. 1 is a circuit diagram of a conventional internal power supply auxiliary circuit.
Figure 2:
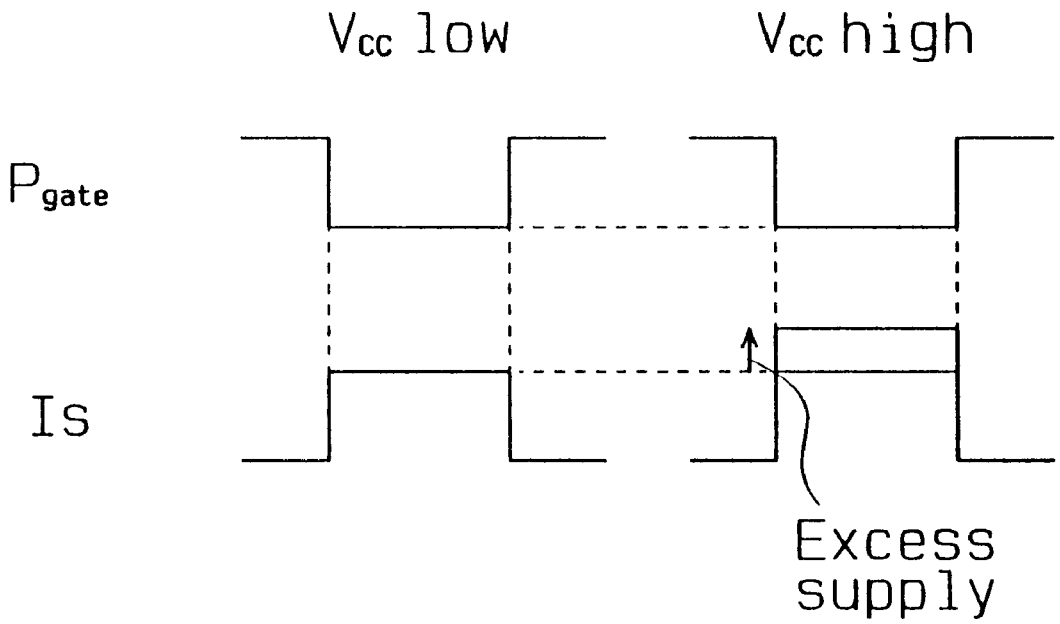
FIG. 2 is a operational waveform chart for the internal power supply auxiliary circuit in FIG. 1.

At this time, the gate voltage regulator 11 works so that the voltage at the node N1 substantially coincides with the reference voltage Vref. That is, the gate voltage regulator 11 sets the voltage at the node N1 to the ground level GND when the external supply voltage $V_{cc}$ is lower than a predetermined voltage, and raises the voltage at the node N1 when the external supply voltage $V_{cc}$ rises above the predetermined voltage. This increase in the voltage at the node N1 permits the drive pulse signal Pgate (see FIG. 1) to have a higher level than the ground level GND supplied from the driver-driving circuit 22 to the gate of the PMOS transistor TP2. Consequently, the potential difference between the gate and source of the PMOS transistor TP2 becomes smaller. This prevents effectively the supply of an excessive supply current Is when the PMOS transistor TP2 is on, thus preventing the current consumption from being increased.

Further, the provision of the PMOS transistor TP5 as a switch circuit and the NMOS transistor TN5 allows the gate voltage regulator 11 to be enabled by the enable signal en only when a current is supplied to the internal power generator 19. This prevents the current consumption from being increased by the operation of the differential amplifier 20 formed in the gate voltage regulator 11.

Figure 5:
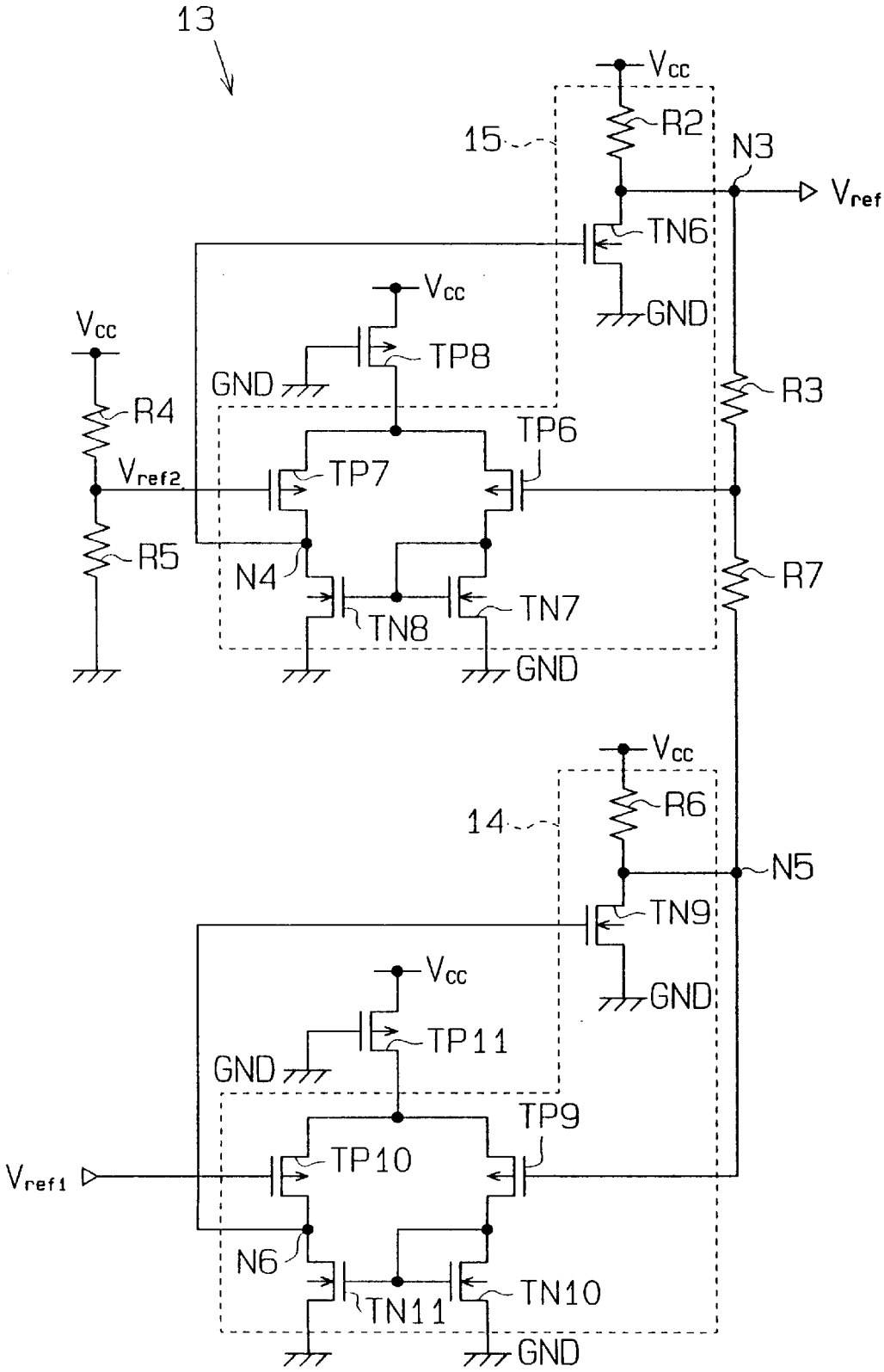
FIG. 5 is a circuit diagram of a reference voltage generator for supplying a reference voltage to the internal power supply auxiliary circuit in FIG. 4.

FIG. 5 is a circuit diagram of the reference voltage generator 13. The reference voltage generator 13 includes first and second current-mirror type differential amplifiers 14 and 15, four resistors R3, R4, R5 and R7, and two PMOS transistors TP8 and TP11.

The first current-mirror type differential amplifier 14 has two PMOS transistors TP9 and TP10, which form a differential amplifier, and two NMOS transistors TN10 and TN11, which form a current mirror circuit. A resistor R6 and an NMOS transistor TN9, which form an output stage, are connected in series between the external supply voltage $V_{cc}$ and the ground GND. The resistor R6 preferably has a resistance substantially higher than the ON resistance of the transistor TN9. A node N5 between the resistor R6 and the NMOS transistor TN9 is connected to a node N3 (i.e., the output terminal of the reference voltage generator 13) via the two resistors R3 and R7, and to a non-inverting input terminal of the second differential amplifier 15 (i.e., the gate of a PMOS transistor TP6) via the resistor R7. The node N5 is further connected to the non-inverting input terminal of the first differential amplifier 14 (i.e., the gate of the PMOS transistor TP9). Therefore, the voltages at the nodes N3 and N5 are divided by the resistors R3 and R7 and the resultant voltages are supplied to the gate (the non-inverting input terminal) of the PMOS transistor TP6. A first reference voltage Vref1 having a substantially constant voltage value is supplied to the inverting input terminal of the first differential amplifier 14 (i.e., the gate of the PMOS transistor TP10).

The PMOS transistors TP9 and TP10 have sources which receive the external supply voltage $V_{cc}$ via the PMOS transistor TP11, which serves as a switch circuit. The PMOS transistor TP11 has a gate connected to the ground GND. The output terminal of the first differential amplifier 14 (or a node N6 between the PMOS transistor TP10 and the NMOS transistor TN11) is connected to the gate of the NMOS transistor TN9.

The second current-mirror type differential amplifier 15 has two PMOS transistors TP6 and TP7, which form a differential amplifier, and two NMOS transistors TN7 and TN8, which forms a current mirror circuit.

The resistor R2 and an NMOS transistor TN6, which form an output stage, are connected in series between the external supply voltage $V_{cc}$ and the ground GND. The resistor R2 preferably has a resistance substantially higher than the ON resistance of the transistor TN6. A node between the resistor R2 and the NMOS transistor TN6 is connected to the node N3, and connected via the resistor R3 to the non-inverting input terminal of the second differential amplifier 15 (i.e., the gate of the PMOS transistor TP6).

The resistors R4 and R5 are connected in series between the external supply voltage $V_{cc}$ and the. ground GND. A second reference voltage Vref2 is supplied to the inverting input terminal of the second differential amplifier 15 (i.e., the gate of the PMOS transistor TP7) from a node between the resistors R4 and R5.

The PMOS transistors TP6 and TP7 have sources which receive the external supply voltage $V_{cc}$ via the PMOS transistor TP8, which serves as a switch circuit. The PMOS transistor TP8 has a gate connected to the ground GND. The output terminal of the second differential amplifier 15 (or a node N4 between the PMOS transistor TP7 and the NMOS transistor TN8) is connected to the gate of the NMOS transistor TN6.

Figure 6:
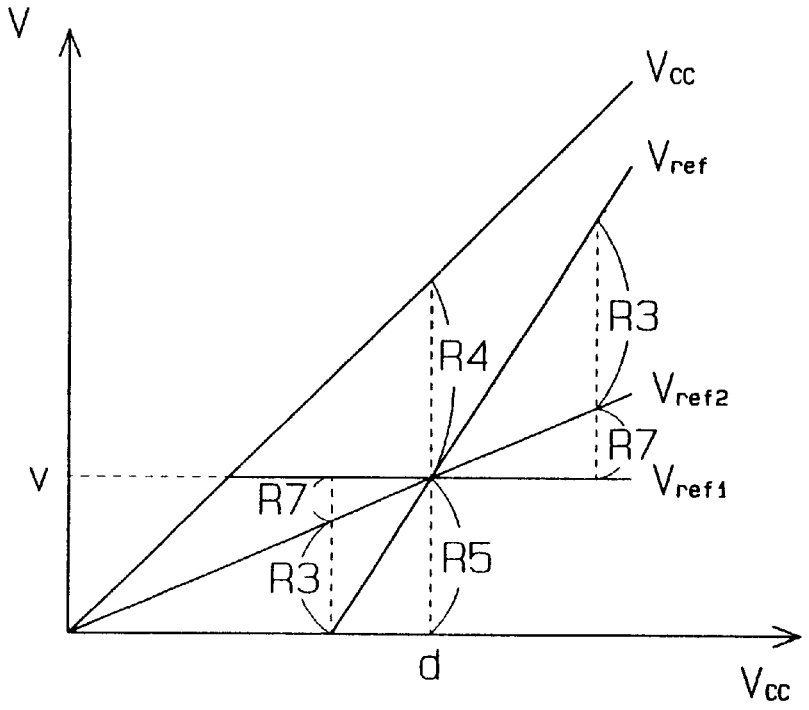
FIG. 6 is a graph showing increase ratios of an external supply voltage and reference voltages.
Figure 7:
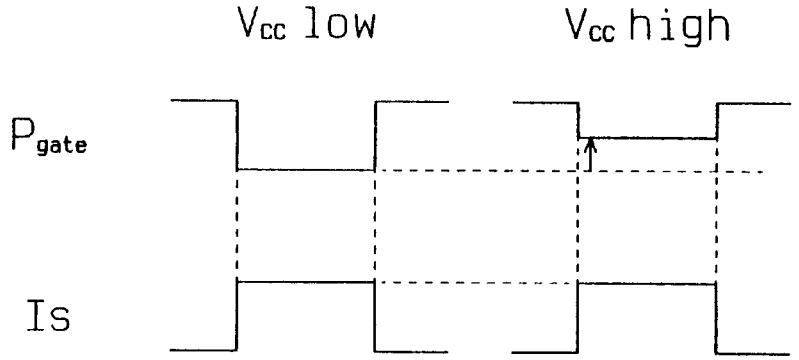
FIG. 7 is a operational waveform chart for the internal power supply auxiliary circuit in FIG. 4.

The first differential amplifier 14 causes the voltage at the node N5 to substantially coincide with the first reference voltage Vref1. The second differential amplifier 15 causes the gate voltage of the PMOS transistor TP6 to substantially coincide with the second reference voltage Vref2. Output from the node N3 is therefore the reference voltage Vref which varies by a predetermined ratio as the external supply voltage $V_{cc}$ rises as shown in FIG. 6.

This will be discussed more specifically. Suppose that the second reference voltage Vref2 substantially coincides with the first reference voltage Vref1 when the external supply voltage $V_{cc}$ has a predetermined voltage value d. Then, the gate voltage of the PMOS transistor TP6 (the second reference voltage Vref2) substantially equals the voltage at the node N5 (the first reference voltage Vref1). Thus, the voltage at the node N3 (i.e., the reference voltage Vref) substantially coincides with the first and second reference voltages Vref1 and Vref2.

When the external supply voltage $V_{cc}$ has a value greater than the predetermined voltage value d, the second reference voltage Vref2 rises and becomes higher than the first reference voltage Vref1. At this time, the gate voltage of the PMOS transistor TP6 also becomes more than the voltage at the node N5. Consequently, the second differential amplifier 15 causes the voltage at the node N3 to become higher than the gate voltage of the PMOS transistor TP6 (i.e., the second reference voltage Vref2) by the voltage drop at the resistor R3. Thus, the reference voltage Vref which is higher than the second reference voltage Vref2 is output from the node N3.

When the value of the external supply voltage $V_{cc}$ is lower than the predetermined voltage value d, the second reference voltage Vref2 becomes lower than the first reference voltage Vref1. At this time, the gate voltage of the PMOS transistor TP6 become less than the voltage at the node N5. Consequently, the second differential amplifier 15 causes the voltage at the node N3 to become lower than the gate voltage of the PMOS transistor TP6 by the voltage drop at the resistor R3. Thus, the reference voltage Vref which is lower than the second reference voltage Vref2 is output from the node N3.

The ratio of a change in reference voltage Vref (the inclination of the reference voltage Vref) with respect to a change in external supply voltage $V_{cc}$ shown in FIG. 6 may be changed as needed by altering the resistances of the resistors R3–R5 and R7. The alteration of the resistances facilitates the setting of the reference voltage Vref. It is preferable to set the inclination of the reference voltage Vref such that an increase in current consumption is prevented as much as possible in accordance with a change in external supply voltage $V_{cc}$.

Figure 8:
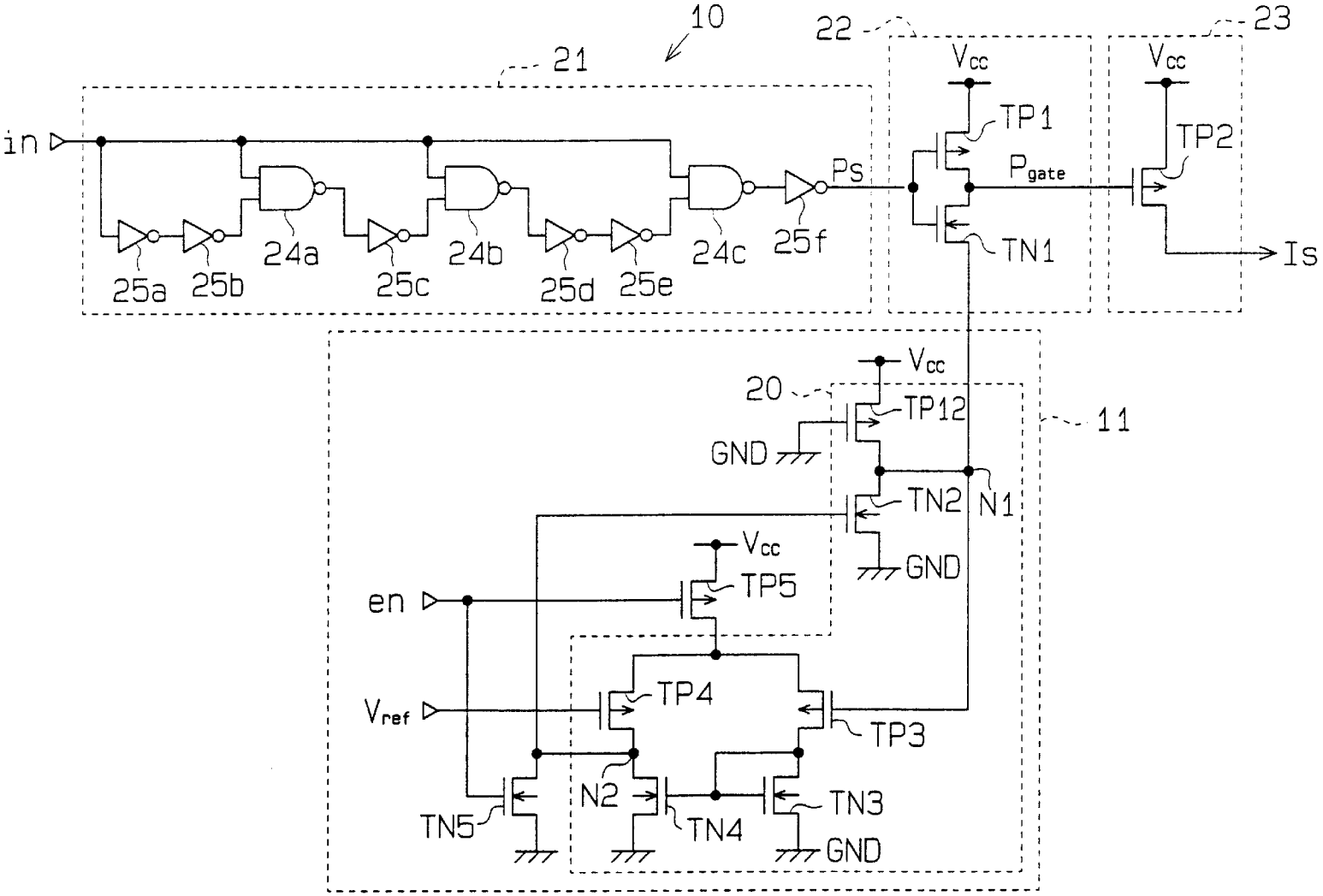
FIG. 8 is a circuit diagram of an internal power supply auxiliary circuit according to a second embodiment of the present invention.

It should be apparent to those skilled in the art that the present invention may be embodied in many other specific forms without departing from the spirit or scope of the invention. Particularly, it should be understood that the invention may be embodied in the following forms. For instance, a PMOS transistor TP12 with a gate connected to the ground GND may be used instead of the resistor R1 as shown in FIG. 8. Likewise, the resistors R2 and R6 in the reference voltage generator 13 may be replaced with MOS transistors. An NMOS transistor or a bipolar transistor may be used in place of the PMOS transistor TP2 in the current supply driver 23. In this case, the pulse signal generator 21 and the gate voltage regulator 11 should properly be modified to match the operation of the NMOS transistor or bipolar transistor.

Therefore, the present examples and embodiment are to be considered as illustrative and not restrictive and the invention is not to be limited to the details given herein, but may be modified within the scope and equivalence of the appended claims.

What is claimed is:

1. A semiconductor integrated circuit device comprising:

an output transistor;

a driving circuit for outputting a drive signal which drives the output transistor in response to a one-shot pulse signal according to an operational mode of the semiconductor integrated circuit device, the output transistor outputting a current based on a first supply voltage in response to the drive signal; and a level regulator, connected to the driving circuit, for regulating a voltage of the drive signal in accordance with a change in the first supply voltage based on a reference voltage such that the output transistor outputs a constant current, wherein the level regulator includes a reference voltage generator for generating the reference voltage which changes according to a change in the first supply voltage.

2. The semiconductor integrated circuit device according to claim 1, wherein the output transistor includes an MOS transistor having a control terminal for receiving the drive signal and a supply terminal for the first supply voltage; and the level regulator regulates the voltage of the drive signal to prevent a potential difference between the control terminal and the supply terminal of the MOS transistor from being increased by a change in the first supply voltage.

3. The semiconductor integrated circuit device according to claim 1, wherein the driving circuit includes a CMOS inverter for receiving the first supply voltage and a second supply voltage, and the level regulator adjusts the voltage of the drive signal by altering the second supply voltage in accordance with a change in the first supply voltage.

4. The semiconductor integrated circuit device according to claim 3, wherein the level regulator includes a differential amplifier for receiving the reference voltage from the reference voltage generator and supplying the second supply voltage substantially equal to the reference voltage to the CMOS inverter.

5. The semiconductor integrated circuit device according to claim 4, wherein the differential amplifier includes an output stage for the first supply voltage, which has an MOS transistor.

6. The semiconductor integrated circuit device according to claim 4, wherein the reference voltage generator includes a voltage-dividing circuit for dividing the first supply voltage to produce a divided voltage.

7. The semiconductor integrated circuit device according to claim 4, further comprising a switch circuit, connected to a differential amplifier, for enabling the differential amplifier in response to an enable signal.

8. A power generator circuit comprising:

a power supply main circuit; and a power supply auxiliary circuit coupled to the power supply main circuit for supplying a current to the power supply main circuit, the auxiliary circuit comprising:

a pulse signal generator which receives an input signal and generates a first one-shot pulse signal according to an operational mode of a semiconductor integrated circuit device employing the power generator circuit therefrom;

a driver-driving circuit connected to the pulse signal generator for receiving the first one-shot pulse signal therefrom, an external supply voltage, and a source voltage and generates a drive pulse signal therefrom;

a current supply driver circuit connected to the driver-driving circuit which receives the drive pulse signal and the external supply voltage and outputs a supply current to the power generator circuit;

a reference voltage generator for producing a reference voltage which changes according to a change in the external supply voltage; and a gate voltage regulator circuit connected to the driver driving circuit and the reference voltage generator, the gate voltage regulator circuit receiving the reference voltage and producing the source voltage, wherein the gate voltage regulator causes the source voltage to substantially match the reference voltage so that the current supply driver circuit outputs a constant supply current.

9. The power supply auxiliary circuit of claim 8, wherein the reference voltage varies by a predetermined ratio as the external supply voltage rises.

10. The power supply auxiliary circuit of claim 8, wherein the gate voltage regulator circuit comprises:

a differential amplifier circuit having an inverting input terminal and a noninverting input terminal;

a current mirror circuit connected to the differential amplifier circuit; and an output stage circuit connected to the differential amplifier circuit, wherein the inverting input terminal receives the reference voltage from the reference voltage generator and the noninverting input terminal is connected to the driver-driving circuit and a node of the output stage circuit.

11. The power supply auxiliary circuit of claim 10, wherein the gate voltage regulator circuit sets the voltage at the node of the output stage circuit to a ground level when the external supply voltage is less than a predetermined value and raises the voltage at the node of the output stage circuit when the external supply voltage is greater than the predetermined value.

12. The power supply auxiliary circuit of claim 8, wherein the current supply driver circuit comprises a transistor having a gate connected to the driver-driving circuit and receiving the drive pulse signal, a source to which the external supply voltage is input, and a drain connected to a current supply terminal of the power generator circuit.

13. The power supply auxiliary circuit of claim 8, wherein the driver driving circuit comprises a CMOS inverter.

14. The power supply auxiliary circuit of claim 13, wherein the CMOS inverter comprises:

a PMOS transistor having a gate connected to the pulse signal generator for receiving the first one-shot pulse signal, a source for receiving an external supply voltage, and a drain; and an NMOS transistor having a drain connected to the drain of the PMOS transistor, a gate connected to the pulse signal generator for receiving the first one-shot pulse signal, and a source connected to the gate voltage regulator for receiving the source voltage.

15. A power supply auxiliary circuit for supplying a current to a power generator circuit, the auxiliary circuit comprising:

a pulse signal generator which receives an input signal and generates a first control signal therefrom;

a driver-driving circuit connected to the pulse signal generator for receiving the first control signal therefrom, an external supply voltage, and a source voltage and generates a drive pulse signal therefrom;

a current supply driver circuit connected to the driver-driving circuit which receives the drive pulse signal and the external supply voltage and outputs a supply current to the power generator circuit;

a reference voltage generator for producing a reference voltage; and a gate voltage regulator circuit connected to the driver driving circuit and the reference voltage generator, the gate voltage regulator circuit receiving the reference voltage and producing the source voltage, wherein the gate voltage regulator causes the source voltage to substantially match the reference voltage, wherein the reference voltage generator comprises:

a first current mirror type differential amplifier having two PMOS transistors which form a differential amplifier having an inverting input and a noninverting input, two NMOS transistors which form a current mirror, and a resistor connected in series with a third NMOS transistor which form an output stage thereof; and a second current mirror type differential amplifier having two PMOS transistors which form a differential amplifier having an inverting input and a noninverting input, two NMOS transistors which form a current mirror, and a resistor and a third NMOS transistor which form an output stage thereof.

16. The power supply auxiliary circuit of claim 15, wherein a first reference voltage having a substantially constant voltage value is supplied to the inverting input of the first current mirror type differential amplifier, and a second reference voltage is supplied to the inverting input of the second current mirror type differential amplifier, and the reference voltage generator further comprises a first resistor and a second resistor connected in series between the external supply voltage and the ground, wherein a node between the first and second resistors supplies the second reference voltage to the inverting input of the second current mirror type differential amplifier.

17. The power supply auxiliary circuit of claim 15, wherein the noninverting input of the first current mirror type differential amplifier is connected to a node between the resistor and the transistor of the output stage of the first current mirror type differential amplifier, to the noninverting input of the second current mirror type differential amplifier by way of a first resistor, and to anode between the resistor and the transistor of the output stage of the second current mirror type differential amplifier by way of the first resistor and a second resistor connected in series with the first resistor.

18. A semiconductor memory device comprising:

a transistor, disposed between an external power supply line and an internal power supply line, having a gate electrode, a source electrode, and a drain electrode;

a driving circuit, operatively connected to the gate electrode and disposed between a first node and a second node, for controlling the transistor in response to a one-shot pulse signal according to an operational mode of the semiconductor memory device, the one-shot pulse signal being generated when the semiconductor memory device initiates its operation; and a level controlling circuit receiving an external power supply voltage and operatively connected to one of the first and second nodes, for controlling a potential at one of the first and second nodes in response to a potential of the external power supply voltage based on a reference voltage such that a potential difference between the gate electrode and one of the source and drain electrodes is maintained constant, wherein the level controlling circuit includes a reference voltage generator for generating the reference voltage which changes according to a change in the external power supply voltage.

19. A semiconductor integrated circuit device comprising:

an output transistor;

a driving circuit for outputting a drive signal which drives the output transistor in response to a control signal, the output transistor outputting a constant current based on a first supply voltage in response to the drive signal; and a level regulator, connected to the driving circuit, for regulating a voltage of the drive signal in accordance with a change in the first supply voltage based on a reference voltage, wherein the level regulator includes a reference voltage generator for generating the reference voltage which changes according to a change in the first supply voltage.

20. A power generator circuit comprising:

a power supply main circuit; and a power supply auxiliary circuit coupled to the power supply main circuit for supplying a current to the power supply main circuit, the auxiliary circuit comprising:

a pulse signal generator which receives an input signal and generates a first control signal therefrom;

a driver-driving circuit connected to the pulse signal generator for receiving the first control signal therefrom, an external supply voltage, and a source voltage and generates a drive pulse signal therefrom;

a current supply driver circuit connected to the driver-driving circuit which receives the drive pulse signal and the external supply voltage and outputs a constant supply current to the power generator circuit;

a reference voltage generator for producing a reference voltage which changes according to a change in the external supply voltage; and a gate voltage regulator circuit connected to the driver driving circuit and the reference voltage generator, the gate voltage regulator circuit receiving the reference voltage and producing the source voltage, wherein the gate voltage regulator causes the source voltage to substantially match the reference.

21. A semiconductor memory device comprising:

a transistor, disposed between an external power supply line and an internal supply line, having a gate electrode, a source electrode, and a drain electrode;

a driving circuit, operatively connected to the gate electrode and disposed between a first node and a second node, for controlling the transistor response to output a constant current, to a pulse signal; and a level controlling circuit receiving an external power supply voltage and operatively connected to one of the first and second nodes, for controlling a potential at one of the external power supply voltage based on a reference voltage, wherein the level controlling circuit includes a reference voltage which changes generator for generating the reference voltage according to a change in the external power supply voltage.

* * * * *